United States Patent [19]

Benages

[11] Patent Number: 4,794,377

[45] Date of Patent: Dec. 27, 1988

[54] MAIL SIGNAL SYSTEM

[76] Inventor: Alexander Benages, 1585 Lakeview Dr., Hillsborough, Calif. 94010

[21] Appl. No.: 863,057

[22] Filed: May 14, 1986

[51] Int. Cl.[4] ..... G08B 21/00

[52] U.S. Cl. ..... 340/569; 232/37; 340/527; 340/539; 340/693

[58] Field of Search ..... 232/17, 34, 35, 36, 232/37; 340/569, 539, 568, 570, 571, 572, 555, 527, 556, 691, 693; 250/222.1, 214 AL

[56] References Cited

U.S. PATENT DOCUMENTS

| | | | |
|---|---|---|---|
| 3,614,734 | 10/1971 | Davis | 340/527 |
| 3,909,819 | 9/1975 | Radford | 340/569 |
| 4,198,563 | 4/1980 | Elssner | 250/214 AL |
| 4,458,146 | 7/1984 | Reiner et al. | 250/222.1 |
| 4,520,350 | 5/1985 | Huang | 340/569 |
| 4,633,236 | 12/1986 | Buhl | 340/569 |

*Primary Examiner*—Glen R. Swann, III
*Attorney, Agent, or Firm*—Julian Caplan

[57] ABSTRACT

A signal to indicate deposit of mail in a box remote from a residence employs an optical reflective detector which senses presence of mail in the box. The transmission may be r. f. if the box is relatively isolated from other boxes. In apartments, condominiums, and the like where multiple boxes are centrally located, transmission may be by special wiring or by imposing a coded signal on house electrical wiring. Means is provided for the detector distinguishing between outgoing mail deposited in the box and new incoming mail.

6 Claims, 2 Drawing Sheets

MAIL SIGNAL SYSTEM

BACKGROUND OF THE INVENTION

1. Field of the Invention

This invention relates to a new and improved mail signal system. More particularly, the invention relates to providing a signal in the residence that mail has been deposited in a mailbox remote from the residence. Means is also provided for distinguishing between mail which has been deposited in the box as outgoing mail and new or incoming mail.

2. Description of Related Art

Various devices have been used to detect the presence of incoming mail. Thus, opening the door of the mailbox has actuated a signal in such references as U.S. Pat. Nos. 3,611,333 and 3,707,260.

The opening of the door admits light which affects the functioning of a photocell within the box in such references as U.S. Pat. Nos. 3,909,819 and 4,314,102, as well as Swiss Pat. No. 600,844.

The opening of a door may actuate a microswitch as in reference U.S. Pat. No. 4,314,102.

U.S. Pat. No. 2,968,804 discloses a device where mail in the box interferes with the signal in a transmitter and receiver in the box. In the present invention, however, the use of an optical reflective detector eliminates the remote receptor and, in addition, the transmission of the signal is improved over what is shown in in that reference.

SUMMARY OF THE INVENTION

A photodiode is located at the top of a mailbox. The presence of an envelope or other mail inside the box thus produces a signal because it interferes with receipt of the light from the photodiode by an infrared emitter. In one form of the invention such signal is transmitted at radio frequency to a receiver in the home tuned to the frequency of the transmitter. On reception of the signal from the transmitter, an indicator lamp is lit and, optionally, an audible signal is activated. The transmitter is preferably located externally on top of the box within a protective cover. The transmitter and cover are sealed by a rubber seal to weatherproof the contents of the box.

A problem with mail indicator systems is to distinguish between outgoing mail which is deposited in the box and incoming mail. Means are disclosed herein to distinguish between outgoing and incoming mail. One such means is to detect the opening of the box when the mail carrier removes the outgoing mail whereby the amount of light inside the box changes.

Other objects of the present invention will become apparent upon reading the following specification and referring to the accompanying drawing in which similar characters of reference represent corresponding parts in each of the several views.

DESCRIPTION OF THE PREFERRED EMBODIMENTS

Figure 1:
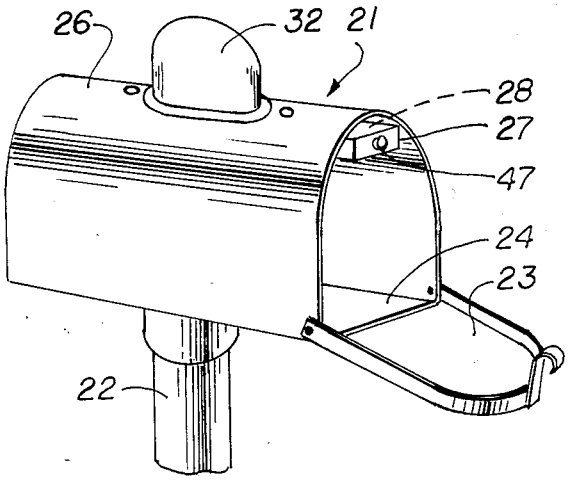
FIG. 1 is a perspective view of one form of the invention showing the mailbox door open.
Figure 2:
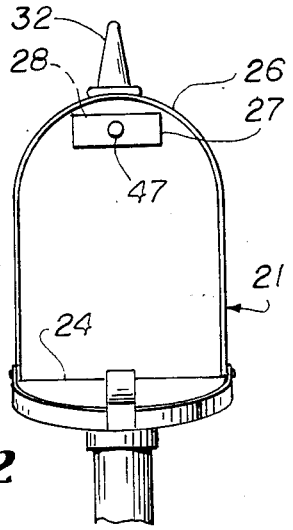
FIG. 2 is a front elevation view thereof.
Figure 3:
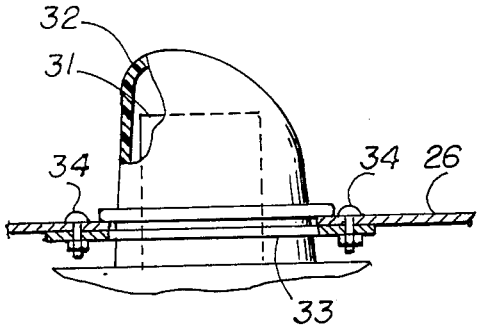
FIG. 3 is an enlarged fragmentary view of the cover for the r.f. transmitter.
Figure 4:
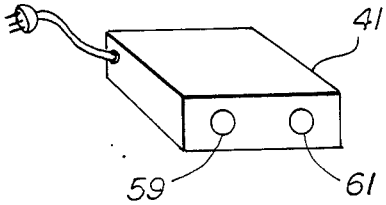
FIG. 4 is a perspective view of a receiver located within a residence or an individual apartment or condominium.

In the form of the invention shown in FIGS. 1–3, a roadside type mail box 21 is supported above the ground by a stand 22. Although the shape of the box 21 is subject to considerable variation, it will be seen that it has a door 23 at one end for the deposit and withdrawal of mail. The main portion of the box has a bottom 24 which is preferably of a color such as not to reflect errant light. The sides and top 26 of the box are formed in conventional fashion. Placed within box 21 immediately below top 26 and adjacent the opening which is closed by door 23, are electronic components hereinafter described. The forward end of unit 27 is an outgoing mail switch 47 and contained therein is off-on switch 28. A radio frequency transmitter is employed in the present invention, the circuit board 31 for which is shown on the outside of the box 21 protected by a shell-like cover 32. An opening (not shown) is formed in the top 26 for communication between the circuit board 31 and the unit 27 and such opening is made weather tight by a seal pad 33 immediately below the cover 32 and held in place by screws 34 or other simple means.

Figure 5:
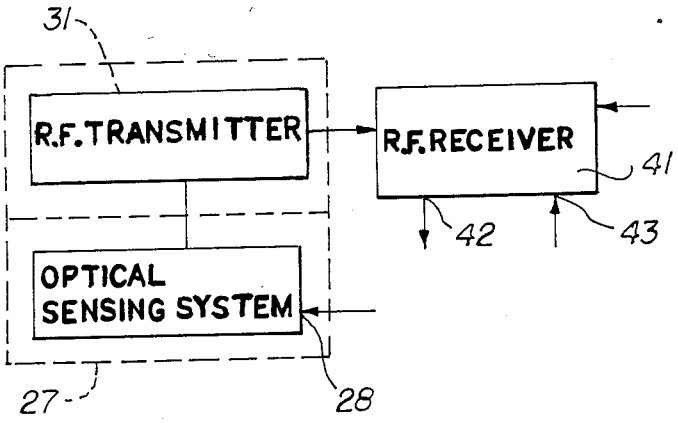
FIG. 5 is a schematic block diagram of the system of FIG. 1–4.

FIG. 5 is a block diagram for the system, as hereinafter described.

Figure 6:
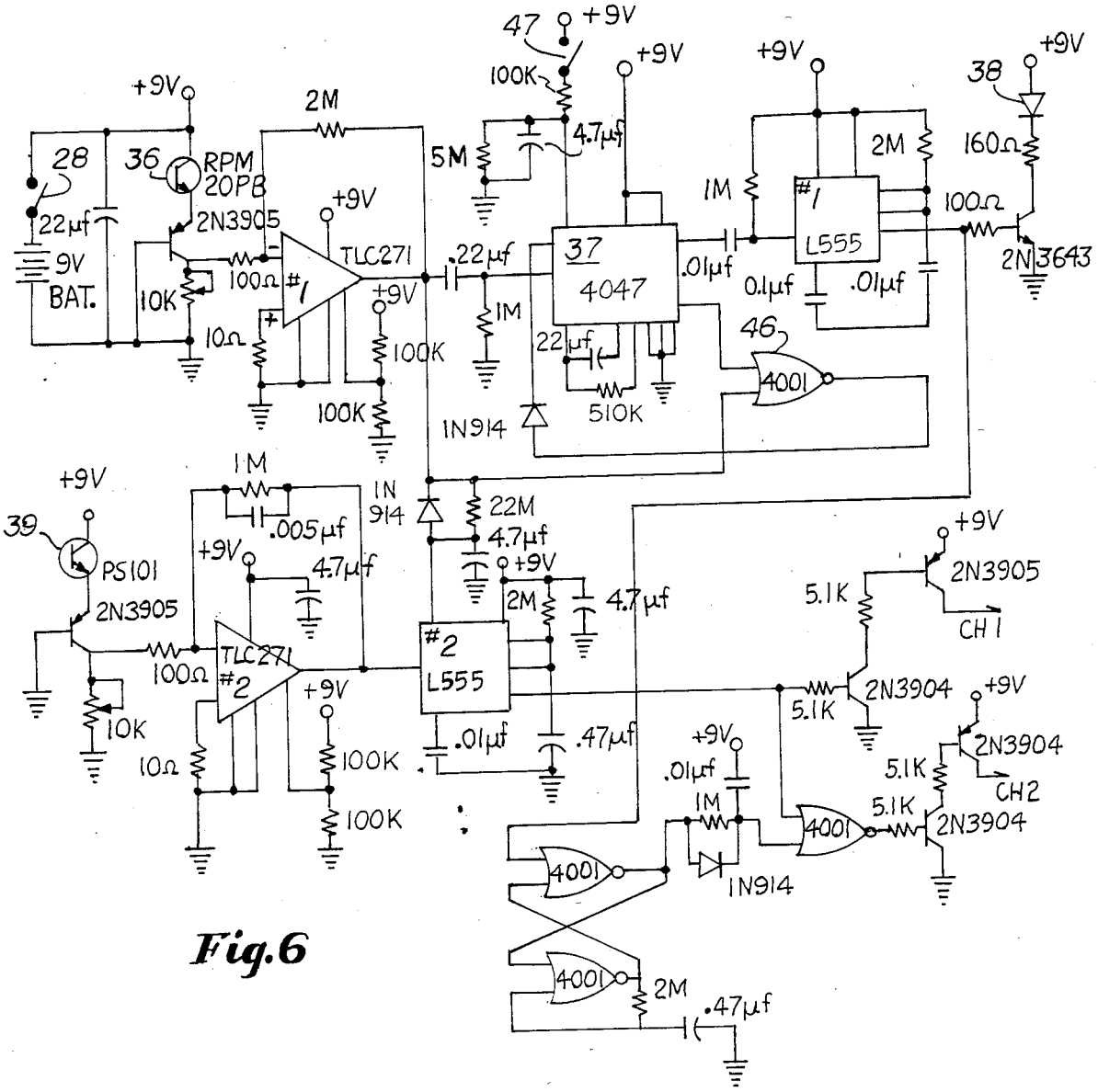
FIG. 6 is a schematic of the optical sensing, logic and associated components.
Figure 7:
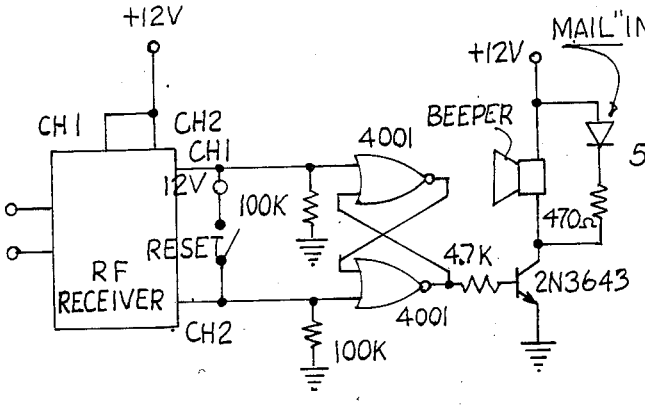
FIG. 7 is a schematic of the r.f. receiver.

A schematic for this system is shown in FIGS. 6 and 7 and hereinafter described.

Located in the residence is a radio frequency receiver 41 receiving the signal from transmitter 31. Receiver 41 has a visual "mail in" signal, or light 59, and a reset button 61. The schematic for receiver 41 is shown in FIG. 7 and hereinafter described.

As shown in the block diagram FIG. 5, once the optical system senses mail, it will trigger or activate the r.f. transmitter 31. A suitable frequency for the transmitter is in the 300 MHz range. The transmission system is similar to garage door openers.

Cover 32 protects the transmitter from the environment. The illustrated cover shape reduces as much as possible disturbance of the transmitter. The cover is designed so that servicing of the transmitter can be done by simply pulling the transmitter out of the housing. The cushioned seal pad 33 at the base of the housing is for weatherproofing the electronics below the housing. The screws 34 function not only to attach the cover to the box but also to connect the electronics.

The reception of the signal is performed by the r.f. receiver 41. Since digital coding is normally used, the receiver is also equipped to digitally decode the signal. Once accepted, the output normally momentary is latched on the additional electronics needed. The latch, of course, powers the "mail in" signal 42 indicator lamp. This lamp stays constantly on until reset switch 43 is pressed.

Directing attention now to the schematic of FIG. 6, when the door 23 is opened, the light admitted is detected by photodiode 36. The signal therefrom is amplified by an operational amplifier 271 No. 1. The output thereof is received by a programmable monostable one-shot multivibrator 37. This has a time delay of approximately one minute. It is connected so that the light signal received by diode 36 triggers it but, further, any additional impulses of light received by diode 36 extends the time duration thereof. Timer 37 is triggered on the falling edges so that the system is not triggered until the door 23 is closed. The purpose of timer 37 is to command the system to operate from a basically standby mode. After the timer 37 has timed out, a signal is directed to the No. 1 L555 which generates a very short (e.g. 30 ms) pulse to drive the transistor 2n3643, which in turn pulses the infrared diode emitter 38. The beam from the emitter 38 is directed to the bottom 24 of box 21 and reflected. Reflections are picked up by the receiving photodiode 39, the outgoing signal of which is amplified by operational amplifier 271 No. 2 which triggers the second L555 r.f. transmit timers, setting the r.f. transmitter to transmit a signal for approximately one to five seconds. The L555 No. 2 timer will not transmit on channel 1 if no signal is present (i.e. no mail is in the box) but instead, the signal is transmitted on channel 2. Channel 2 represents a reset channel.

If mail was previously in the box and the box is opened and the mail removed, reset channel 2 will automatically update the status of mail in the box. Reset channel 2 is initiated by a pulse command infrared pulse to L555 No. 1 timer, which is set for exactly the same time as the second L555 timer. The two signals then pass through the NOR gates and if no signal is received from the L555 No. 2, the signal from L555 No. 1 will then trigger the channel 2 transmitter.

By pushing the outgoing mail button 47, the one-shot 37 command is disabled and hence upon closing the box the status of the box is disabled and the outgoing mail may be inserted without a system error. When the outgoing mail is picked up, the status of the mail is automatically updated.

It should further be noted that when the customer picks up the mail from the box, it is unnecessary to reset the receiver since this is done automatically every time the box is opened.

To control a "mail in" indicator 59, a CMOS 4001 circuit is shown in FIG. 7. This functions as a latch so that channel 1 will latch the "mail in" indicator light LED 59 on continuously and channel 2 (or the manual reset switch) 61 will unlatch the LED "mail in" indicator 59. Optionally an audible tone beeper may be connected to cause a tone, if desired.

Figure 8:
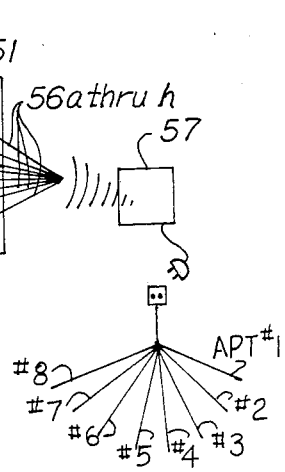
FIG. 8 is a block diagram showing use of the invention in an apartment house or condominium.

Directing attention now to FIG. 8, an apartment house or condominium multi-box unit 51 is shown having a plurality of mail slots 52 separated by partitions 53. Wiring into such a box may be difficult if there is concrete or if there is no access behind the box. Accordingly, each box is provided with a system similar to FIG. 6. This is received in a centralized reeeiving unit which discriminates between the different signals from each of the boxes. Such a signal is then transmitted through a carrier current such as a household lighting system to the individual apartment houses. Alternatively, a mail detection unit is connected to the individual mail boxes and the "mail in" information is stored in a centralized decode telephone computer. The resident then calls his or her telephone number and receives a recorded message of whether mail is present in the box or not.

The embodiments herein described and illustrated are designed for individual mailboxes 21 relatively isolated from other boxes. Directing attention to FIG. 8, the invention may be extended to condominium and apartments there is a central mailbox console 51 having a plurality of mail slots 52 separated by partitions 53. Because of the large number of boxes involved and the longer distances from the boxes to the living quarters, different means of transmission may be used. Rather than using r.f transmission, carrier current may be used (i.e., digital transmission along the 115 VAC household current lines). Each mailbox unit 52 has its own optical sensor similar to sensors 27 described in the preceding embodiments. Upon activation, the signal is sent to a master transmission unit by means of lines **56*a*, 56*b*, 56*c*, etc., respectively. In the box 57, coding for the individual units and transmission occurs. Such transmission is sent along the 115 VAC power lines in the 80–200 KHz range. Each condominium or apartment is equipped with a receiver and indicator unit shown in FIG. 7 and having a "mail in" signal 59 and a reset button 61. The receiver shown in FIG. 7** is of a "carrier current" type (rather than r.f.) with a suitable digital , decoding to differentiate between the several apartment units.

Alternatively, instead of using a carrier current, where the system is installed in a new building, direct wires from the sensors to the receivers 58 may be substituted.

What is claimed is:

1. A remote incoming signal system comprising a mailbox having a top, bottom and an open end, a door for closing off said open end, a reflective optical sensor positioned below said top having a photodiode transmitter directed at said bottom and a photodiode receiver to receive the reflected signal of said photodiode transmitter whereby presence of mail in said box effects the transmission between the photodiode transmitter and photodiode receiver and triggers an r.f. transmitter, an r.f. receiver remote from said r.f. transmitter tuned to said r.f. transmitter, a "mail in" signal energized by said r.f. receiver, discriminating means in said mailbox including a photodiode discriminator energized by light received upon opening said door, and a timer connected to said photodiode discriminator emitting a pulse to said photodiode transmitter a fixed time after said door is opened and then closed to trigger said r.f. transmitter.

2. A system according to claim 1 in which said r.f. transmitter is located on the top of said mailbox and which further comprises a shell cover over said r.f. transmitter.

3. A system according to claim 1 which further comprises at least one second mailbox in proximity to said first-mentioned mailbox, a second photodiode transmitter and a second photodiode receiver in said second mailbox, said r.f. transmitter emitting one signal when incoming mail is positioned in said first-mentioned mailbox and a different signal when incoming mail is positioned in said second mailbox and a second r.f. receiver in a different location from said first-mentioned r.f. receiver.

4. A system according to claim 1 in which said timer is a one-shot multivibrator having a time delay to activate said system from a standby mode to an operational mode and thereby to energize a second timer to emit a pulse to energize said photodiode transmitter, said photodiode transmitter being of an infrared type.

5. A system according to claim 4 in which the signal from said photodiode transmitter is reflected from the bottom of said box to said photodiode receiver, incoming mail in said box interrupting said last-mentioned signal.

6. A system according to claim 5 in which the signal of said photodiode receiver triggers a third timer, said r.f. transmitter having a first and a second channel, said first channel being activated only when there is mail in the box, said second channel being activated when there is no mail in the box and being inactivated if said door is opened to remove mail.

* * * * *